United States Patent [19]

Benker et al.

[11] Patent Number: 4,759,410

[45] Date of Patent: Jul. 26, 1988

[54] SIDE POCKET MANDREL HAVING FORGED INDENTATIONS

[75] Inventors: Wilhelm E. Benker, Huntsville; James H. Holt, Jr., Conroe; Max A. Threadgill, Walker County, all of Tex.

[73] Assignee: Hughes Tool Company, Houston, Tex.

[21] Appl. No.: 904,523

[22] Filed: Sep. 5, 1986

[51] Int. Cl.[4] ..... E21B 23/03

[52] U.S. Cl. ..... 166/117.5; 166/242; 228/174; 29/522.1

[58] Field of Search ..... 166/117.5, 117.6, 242; 228/174; 29/515, 522 R

[56] References Cited

U.S. PATENT DOCUMENTS

| | | | |
|---|---|---|---|
| 3,741,299 | 6/1973 | Terral | 166/117.5 |
| 4,030,543 | 6/1977 | McGinn | 166/117.5 |
| 4,106,563 | 8/1978 | Gatlin et al. | 166/117.5 |
| 4,106,564 | 8/1978 | Tausch | 166/117.5 |
| 4,197,909 | 4/1980 | Terral | 166/117.5 |
| 4,201,265 | 5/1980 | Thomason et al. | 29/522 R |
| 4,271,902 | 6/1981 | Moore, Jr. | 228/174 |
| 4,416,330 | 11/1983 | Merritt | 166/242 |
| 4,498,533 | 2/1985 | Johnston | 166/117.5 |
| 4,553,310 | 11/1985 | Logan | 29/517 |
| 4,673,036 | 6/1987 | Merritt | 166/117.5 |

FOREIGN PATENT DOCUMENTS

| | | | |
|---|---|---|---|
| 1119400 | 6/1956 | France | 166/117.5 |

*Primary Examiner*—Stephen J. Novosad
*Assistant Examiner*—Terry Lee Melius
*Attorney, Agent, or Firm*—Charles D. Gunter, Jr.

[57] ABSTRACT

A side pocket mandrel for use in well tubing. The mandrel has a body, having an open bore extending through the body in alignment with the well tubing, and a side pocket offset from the bore. A valve receptacle is formed in the side pocket of the mandrel. The body of the mandrel has a plurality of forged indentations. These indentations are axially spaced above the valve receptacle and extend into the side pocket for a distance sufficient to keep well tools from entering the valve receptacle. The indentations may also taper away from the valve receptacle.

2 Claims, 2 Drawing Sheets

SIDE POCKET MANDREL HAVING FORGED INDENTATIONS

BACKGROUND OF THE INVENTION

1. Field of the Invention

This invention relates in general to the field of oil and gas well tubing. In particular, the invention relates to side pocket mandrels for use in well tubing.

2. Description of the Prior Art

When side pocket mandrels are used in a string of well tubing, a tool discriminator must be used to guide valves into the valve receptacle in the side pocket, and to keep well tools from catching on the valve receptacle or on the installed valve tool post. These discriminators may be formed as a part of the mandrel body or internally mounted.

Forged tool discriminators have tended to be expensive and difficult to manufacture. The internally mounted discriminators have the disadvantage that sometimes a space exists between the discriminator and the interior wall of the mandrel. This space may cause well tools to catch on the discriminator itself, thus defeating the purpose of the discriminator.

SUMMARY OF THE INVENTION

The side pocket mandrel of the invention is relatively easy and inexpensive to manufacture, and yet there is no space between the discriminator and the wall of the mandrel, so well tools do not catch on the discriminator. The discriminator in the side pocket mandrel of the invention is an indentation in the wall of the mandrel body. The indentation extends into the side pocket for a distance sufficient to deflect well tools away from the valve receptacle. However, the indentation will still allow a valve to enter the valve receptacle.

The discriminator may consist of a plurality of indentations in the mandrel wall. The indentations may be axially spaced along the mandrel body, and may taper away from the valve receptacle. Also, the indentations of the discriminator may be above or below the valve receptacle.

The above, as well as additional objects, features, and advantages of the invention, will become apparent in the following detailed description.

DECRIPTION OF THE DRAWINGS

DESCRIPTION OF THE PREFERRED EMBODIMENT

Figure 1:
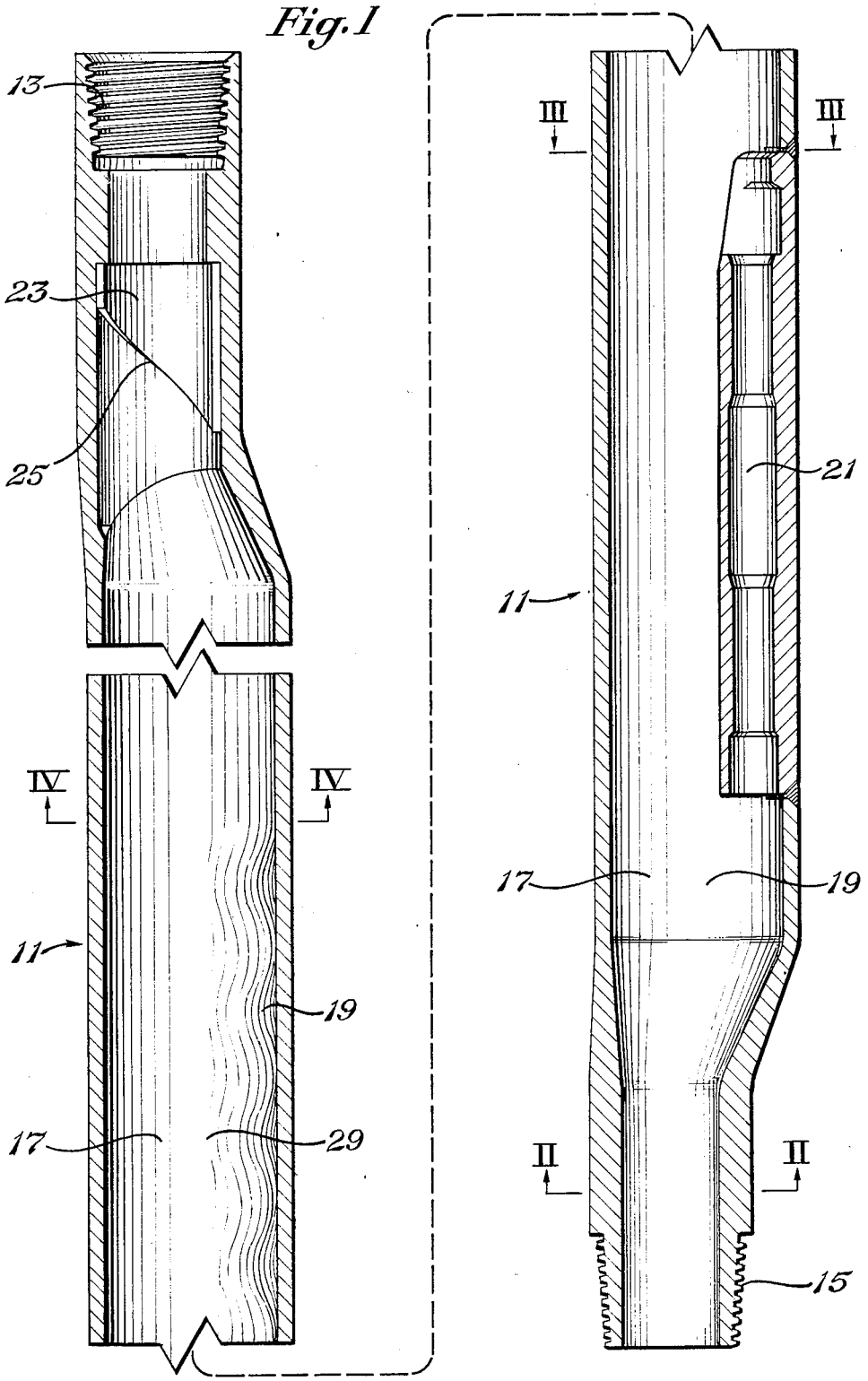
FIG. 1 is a sectional view of the side pocket mandrel of the invention.
Figure 2:
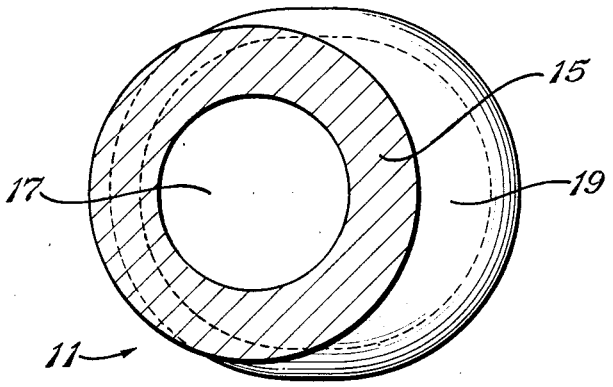
FIG. 2 is a sectional view of the side pocket mandrel of the invention as seen along lines II—II in FIG. 1.
Figure 3:
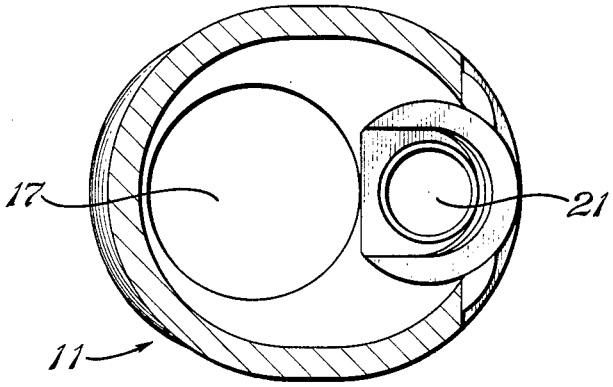
FIG. 3 is a sectional view of the side pocket mandrel of the invention as seen along lines III-III in FIG. 1.

The body 11 of the side pocket mandrel of the invention has a threaded connection 13 at the top, and a threaded connection 15 at the bottom, as shown in FIG. 1. These threaded connections 13, 15 are cylindrical, and sized to connect the body 11 of the mandrel into a string of well tubing (not shown).

Between the two threaded connections 13, 15, the body 11 has an open main bore 17 extending through the body 11 in alignment with the well tubing. The body 11 also has a side pocket 19 offset from the main bore 17. A valve receptacle 21 in the side pocket 19, can hold various types of downhole valves. The side pocket 19 allows the valve to remain in place, while other well tools are being run into or out of the well tubing through the main bore 17.

An orientating sleeve 23 is located in the main bore 17 above the side pocket 19. The orientating sleeve 23 has a helical surface 25 for rotationally orientating a kick-over tool for properly aligning a downhole valve for insertion into the valve receptacle 21.

Figure 5:
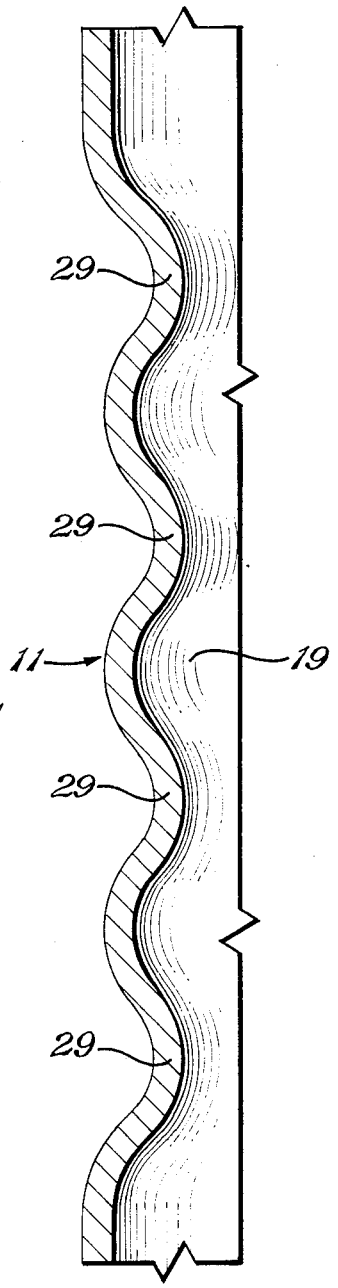
FIG. 5 is a sectional view of the side pocket mandrel of the invention as seen along lines V—V in FIG. 4.

As seen in FIG. 5, the body 11 of the mandrel has indentations 29, axially spaced above the valve receptacle 21. The indentations 29 are forged into the body 11 of the mandrel, and extend into the side pocket 19.

Figure 4:
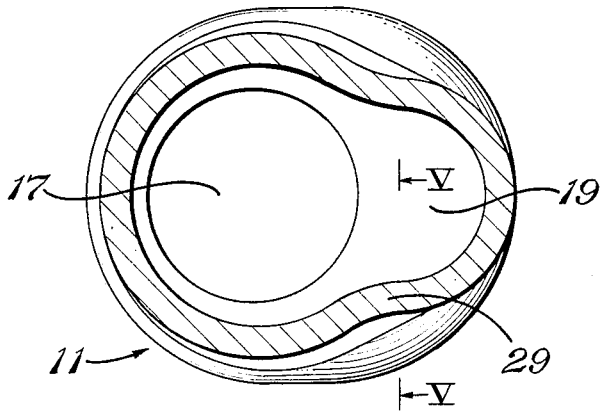
FIG. 4 is a sectional view of the side pocket mandrel of the invention as seen along lines IV—IV in FIG. 1.

FIG. 4 shows that the indentations 29 are wide enough to allow valves to be inserted into the valve receptacle 21, but narrow enough to keep other tools from entering or contacting the valve receptacle 21. These indentations 29 thus constitute the discriminator of the side pocket mandrel. The indentations 29 may be of a uniform size, or the indentations 29 may taper away from the valve receptacle 21, so that the indentations 29 farther away from the receptacle 21 are smaller than the indentations 29 closer to the receptacle 21.

Indentations may also be forged into the body 11 of the mandrel below the valve receptacle 21. These indentations would keep tools from entering the valve receptacle 21 from below, as the tools are being removed from the well.

Another form of the invention has only a single indentation. This single indentation may extend through all or part of the length of the side pocket 19.

The side pocket mandrel of the invention has several advantages over the prior art. The invention is easier and less expensive to manufacture than the prior art devices. Also, since the indentations 29 are integral to the body 11 of the mandrel, there is no gap between the discriminator and the body 11 for tools to hang up on.

The invention has been shown in only one of its forms. It should be apparent to those skilled in the art that it is not so limited, but is susceptible to various changes and modifications without departing from the spirit thereof.

We claim:

1. A side pocket mandrel for use in well tubing, the mandrel comprising:

a body having sidewalls, an open bore extending through the body in alignment with the well tubing, and a side pocket offset from the bore;

a valve receptacle, in the side pocket of the body, for holding a valve, the valve receptacle having a mouth opening; and the body having a plurality of integral, forged indentations formed by moving the sidewalls of the body radially inward at axially spaced locations beginning immediately above the mouth opening of the valve receptacle so that the indentations extend into the side pocket for a distance sufficient to keep tools other than the valve from contacting the valve receptacle, the indentations forming an undulating pattern which tapers away from the valve receptacle in a vertical direction.

2. A method of manufacturing a side pocket mandrel for use in well tubing, the mandrel being of the type having a body with sidewalls, an open bore extending through the body in alignment with the well tubing, and a side pocket offset from the main bore, the method comprising the steps of:

providing a valve receptacle in the side pocket of the body for holding a valve, the valve receptacle having a mouth opening; and providing a discriminator for the valve receptacle by forging a plurality of indentations in the body by moving the sidewalls radially inward at axially spaced locations beginning immediately above the mouth opening of the valve receptacle so that the indentations extend into the side pocket for a distance sufficient to keep tools other than the valve from contacting the valve receptacle, the indentations forming an undulating pattern which tapers in a vertical direction away from the valve receptacle.

* * * * *